United States Patent [19]

McBride et al.

[11] Patent Number: 4,740,214

[45] Date of Patent: Apr. 26, 1988

[54] PROCESS FOR PATTERN DYEING OF TEXTILE MATERIALS

[75] Inventors: Daniel T. McBride, Chesnee; Thomas E. Godfrey, Moore, both of S.C.

[73] Assignee: Milliken Research Corporation, Spartanburg, S.C.

[21] Appl. No.: 734,680

[22] Filed: May 16, 1985

[51] Int. Cl.[4] ..... C09B 67/00

[52] U.S. Cl. ..... 8/561; 8/555

[58] Field of Search ..... 8/555, 557, 561, 654, 8/908, 478, 479

[56] References Cited

U.S. PATENT DOCUMENTS

| | | | |
|---|---|---|---|
| 3,349,079 | 10/1967 | Freedman | 536/3 |
| 4,222,740 | 9/1980 | Bohrn et al. | 8/1 R |
| 4,270,916 | 6/1981 | Racciato | 8/561 |

FOREIGN PATENT DOCUMENTS

| | | | |
|---|---|---|---|
| 0015471 | 2/1981 | Japan | 8/555 |
| 0752336 | 7/1956 | United Kingdom . | |

*Primary Examiner*—Paul Lieberman
*Assistant Examiner*—John F. McNally
*Attorney, Agent, or Firm*—Terry T. Moyer; H. William Petry

[57] ABSTRACT

A process is provided for the pattern dyeing of textile materials wherein dye migration may be controlled by the in-situ formation of a water-insoluble polymeric skin around individual dye droplets when the dye solution is applied to the textile material. The skin is formed by the ionic interaction of an anionic, water-soluble, organic component with a cationic, water-soluble, organic component. Either or both of the components may be a polymeric material.

13 Claims, 2 Drawing Sheets

PROCESS FOR PATTERN DYEING OF TEXTILE MATERIALS

BACKGROUND OF THE INVENTION

This invention relates to a process for pattern dyeing of textile materials whereby improved pattern definition may be achieved. In one aspect the invention relates to a process whereby a chemical interaction takes place between components of a dye solution and components of a textile pretreatment solution to produce a reaction product.

Textile materials have heretofore been pattern colored with natural and synthetic dyes by numerous processes, such as transfer printing, jet dye injection, screen printing and the like. Further, such processes have been employed to print a color decoration on the surface or surfaces of the material in definite repeated forms and color to produce a pattern. While such prior art dyeing processes have met with success, problems have nevertheless been encountered in the pattern dyeing of textile substrates. For instance, when pattern dyeing textile materials, problems have often been encountered in that the repeating units of a pattern are not sharply defined; frosting occurs on the dyed material, and the color is not uniform throughout the dyed textile material. Many of these problems have been thought to result from undesired migration of the dyestuff after it has been applied to the textile material but prior to its actual fixation to the textile material.

Numerous attempts have been made to solve the above-mentioned problems without much success. For instance, it has been suggested to reduce the dye migration problem by incorporation of an antimigration agent in a dye solution. Among the antimigrating agents known in the prior art are natural gums; poly (vinyl methyl ether/maleic anhydride) derivatives as disclosed in U.S. Pat. No. 3,957,427; melamine formaldehyde and urea formaldehyde resins as disclosed in U.S. Pat. No. 4,132,522; Kelgin RL (Kelco Co.); Superclear 100N (Diamond Shamrock); and the like.

The use of antimigration agents has found restricted application in the textile dyeing industry. Some agents merely increase the viscosity of a dye medium without controlling dye migration significantly. Other agents tend to coagulate dyestuff values and reduce color yield. Also, the selection of the quantity of antimigration agent to be employed can be critical, and consequently the control of dye medium viscosity may be difficult.

Accordingly, it is a main object of this invention to provide a process for achieving attractive pattern effects on textile materials with improved sharpness, uniformity and color yield.

It is another object of this invention to provide an improved process for applying sharply delineated dye patterns on a flat textile material by controlling dye migration.

Other objects and advantages of the present invention shall become apparent from the accompanying description and examples.

SUMMARY OF THE INVENTION

As one means for pattern dyeing a textile material, this invention provides a process which comprises: (a) applying to the textile material an aqueous solution; (b) contacting the textile material with a pattern of an aqueous dye solution whereupon a polymeric, water-insoluble skin is formed around individual droplets of said dye solution, the skin being formed by the ionic interaction of two components, one component being provided in the dye solution and the other component having been provided by the previously applied aqueous solution; and (c) fixing the dye to the textile material.

According to the invention one of the components is an anionic component and the other is a cationic component. Furthermore, at least one of the two components is a polymeric material, e.g., a material having a molecular weight of at least about 5,000, preferably at least about 10,000. Thus if the anionic component is a polymeric material, for instance an anionic biopolysaccharide, then the cationic component may be either a polymeric material, e.g., a polyacrylamide copolymer having cationic groups, or a non-polymeric material, e.g., a cationic surfactant such as didecyl dimethyl ammonium chloride. If the cationic component is a polymeric material, for instance a polyacrylamide copolymer having cationic groups, then the anionic component may be either polymeric, e.g., anionic biopolysaccharide or nonpolymeric, e.g., an anionic surfactant such as sodium dodecyl benzene sulfonate. Preferably both the anionic component and the cationic component are polymeric materials each having a molecular weight of at least about 5,000, preferably at least about 10,000.

The cationic component and the anionic component desirably come into contact with each other when the dye solution is applied to the textile material. An ionic interaction then occurs to form a water-insoluble, dye impermeable skin around individual dye droplets thereby effectively controlling undesired migration of the dye. If, for instance, the cationic component and anionic component are allowed to react prior to application of the dye to the textile material the dye droplets which may be formed may make application of the dye in the desired pattern very difficult or even impossible. If, on the other hand, the cationic component and anionic component are caused to react after the dye solution has been in contact with the textile material for any appreciable period of time, the dye may have already migrated undesirably.

The desired timing of the ionic interaction of the cationic component with the anionic component may conveniently be accomplished by applying one of the components to the textile material prior to application of the dye solution in the desired pattern and then applying the corresponding counter-ionic material as a component of the dye solution. Thus if the cationic component is first applied to the textile material as a component of the aqueous solution, the anionic component may be applied as a component of the dye solution. Similarly, if the anionic component is first applied to the textile material as a component of the aqueous solution, the cationic component may be applied as a component of the dye solution.

After the dye solution has been applied the textile material may then be further processed in a conventional manner to effect fixation of the dye to the textile material. Typically heat may be applied in the form of steam. The energy typically employed in conventional fixation procedures will cause the skin to rupture allowing the dye to come into contact with the textile material where it is then fixed to the textile material before undesired migration is allowed to occur.

A drawing accompanies and is made a part of this disclosure.

DETAILED DESCRIPTION OF THE INVENTION

Figure 1:
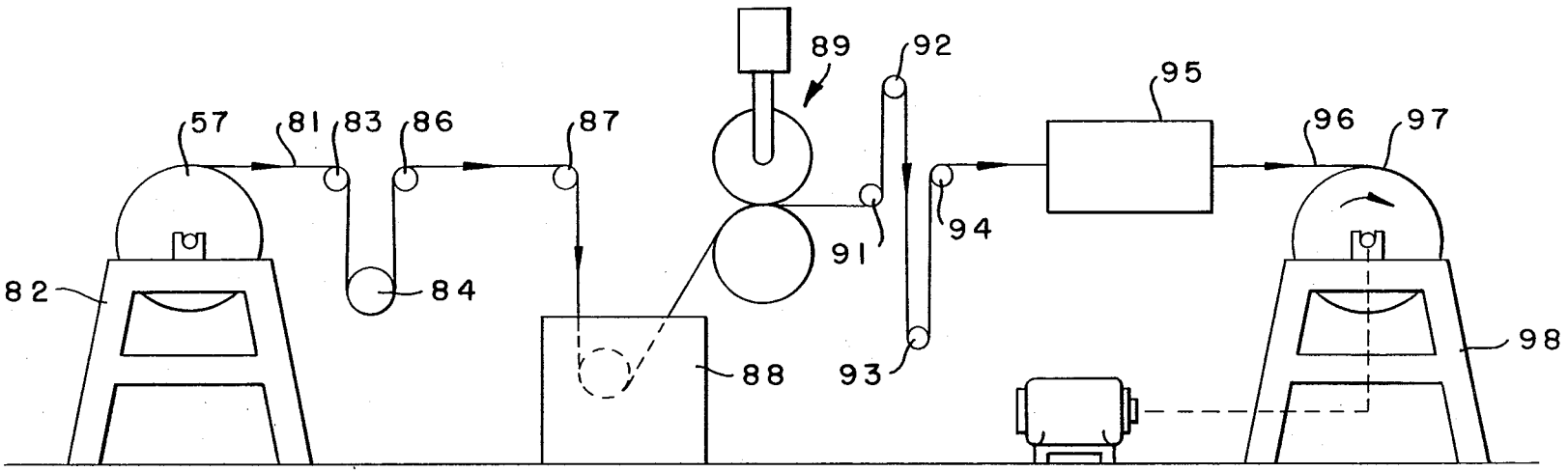
FIG. 1 is a schematic representation of an apparatus which may be employed to apply the aqueous solution to the textile material.

If the cationic component is a polymeric material, the anionic component of the present invention may include a wide range of anionic, water-soluble organic components that may preferably have a molecular weight in excess of about 5,000, or even more preferably in excess of about 10,000. Typically polymeric materials have been found to be quite useful. Examples of preferred anionic components include anionic polybiosaccharide, polyacrylic acid and anionic acrylamide copolymers.

If the anionic component is polymeric, the cationic component may include a wide range of cationic, water-soluble organic materials having a nitrogen-containing cationic group, such as an ammonium group. The anionic component may be polymeric or non-polymeric, although polymeric materials, e.g., those having a molecular weight in excess of about 5,000, preferably in excess of about 10,000, are preferred. Thus, for instance, a wide range of ammonium salts may be used. Examples of preferred cationic materials include cationic polyacrylamide copolymers, e.g., polyacrylamide copolymers containing primary, secondary and tertiary amines, both quaternized and non-quaternized.

As mentioned above, an aqueous solution containing one of the skin forming ionic components is applied to the textile material prior to application of the dye solution. This ionic component, i.e., either the anionic component or cationic component, may typically be provided in the solution in an amount of from about 0.2 percent to about 10 percent, preferably from about 0.5 to about 5 percent, by weight based upon the weight of the aqueous solution.

A wide range of additional textile dyeing pretreatment chemicals may also optionally be provided in the aqueous solution so long as those chemicals do not interfere with the skin forming interaction as discussed above. Examples include, for instance, wetting agents, buffers, etc. Ideally the pH of the aqueous solution may be from about 3 to about 9, although the pH is not critical.

The amount of aqueous solution applied to the textile material may vary widely from an amount sufficient to thoroughly saturate the textile material to an amount that will only barely moisten the textile material. The amount of cationic or anionic component provided may vary widely depending upon the molecular weight, number of ionic groups, etc., but in general the amount applied may be from about 1 percent to about 200 percent, preferably about 5 percent to about 100 percent by weight based upon the weight of the textile material.

After application of the aqueous solution, the textile material may be dried prior to application of the dye solution or alternatively the dye solution may be applied directly without prior drying of the textile material.

As used herein, the term dye solution is defined to include a wide variety of dye liquors. Thus, for instance, the dye may be dissolved in the aqueous medium or alternatively the dyestuff may not be completely dissolved but rather merely dispersed or suspended in the aqueous medium in a form conventionally regarded as suitable for pattern dyeing end use applications. In general, the dye solution which is to be applied to the textile material will contain one or more conventional dyestuffs including acid dyes, disperse dyes, direct dyes and the like, depending upon the textile material to be dyed. Concentration of dye in the dye solution may be in a range that is conventional for textile dyeing operations, e.g., about 0.01 to about 2, preferably about 0.01 to about 1.5 percent by weight based upon the weight of the dye solution. Other conventional ingredients and additives may be provided in the dye solution such as acidic materials, levellers, thickeners and defoaming agents, as will be apparent to those skilled in the art. The anionic or cationic component present in the dye solution may perform certain desired functions in the dye solution in addition to the primary function as described above. Thus it has been found in particular that such components may control the desired rheology characteristics of the dye solution which may vary widely depending upon the patterning technique employed.

Textile materials which can be pattern dyed by means of the present invention include a wide variety of textile materials, e.g., knitted and woven materials, tufted materials, and the like. Generally such textile materials may include carpeting, drapery fabrics, upholstery fabrics, including automotive upholstery fabrics and the like. Such textile materials can be formed of natural or synthetic fibers, such as polyester, nylon, wool and acrylic, including textile materials containing mixtures of such natural and synthetic fibers.

As mentioned above, the textile material can be dyed by any suitable method such as jet injection dyeing, screen printing and the like, especially where a printed color decoration on the surface of the textile material is desired or when definite repeated forms and colors are employed to form a pattern. Especially desirable results can be obtained when the textile materials are dyed using a jet dyeing process and apparatus such as disclosed in U.S. Pat. Nos. 4,084,615; 4,034,584; 3,985,006; 4,059,880; 3,937,045; 3,894,413; 3,942,342; 3,939,675; 3,892,109; 3,942,343; 4,033,154; 3,969,779; and 4,019,352; each of said patents being hereby expressly incorporated by reference.

In a jet injection dyeing process and apparatus such as set forth in U.S. Pat. No. 3,969,779, a jet pattern dyeing machine is provided with a plurality of gun bars each containing plural dye jets extending across the width of an endless conveyor. The gun bars are spaced along the conveyor, and the textile material is carried by the conveyor past the gun bars where dyes are applied to form a pattern thereon. The application of the dye from the individual dye jets in the gun bars is controlled by suitable adapted pattern control means such as mentioned in U.S. Pat. Nos. 3,969,779 and 4,033,154. The pattern-dyed, textile material is then passed through a steamer wherein the dyed textile material is subjected to a steam atmosphere to fix the dyes thereon. The dyed textile material leaving the steam chamber is conveyed through a water washer to remove excess unfixed dyes and other chemicals therefrom. The washed textile material is then passed through a hot air dryer to a delivery and take-up means.

DETAILED DESCRIPTION OF THE DRAWING

In order to more fully depict the process for improving the dyeability of textile materials in accordance with the invention reference will now be made to the drawing. The drawing represents schematic diagrams of sequential processing steps. However, it is to be understood that one could conduct such sequential processing steps as a continuous process.

Referring now to the drawing and particularly FIG. 1, a process and apparatus suitable for applying the aqueous solution to the textile material is set forth. Supply roll 57 contains textile material 81. Supply roll 57 is mounted on a suitable support 82 and the advancement of material 81 through the apparatus for applying the aqueous solution is indicated by the solid line in the direction of the arrows. Textile material 81 is advanced over a plurality of support rollers 83, 84, 86 and 87 and into pad bath means 88. Textile material 81 is maintained in a substantially taunt position throughout the process and is advanced from pad bath means 88, where the aqueous solution is applied to the textile material, through press roll means 89 where excess liquid is removed from the padded textile material. Thereafter, the wet textile material may be passed over a plurality of support rollers 91, 92, 93, and 94 and then optionally into drying oven 95. The material is advanced through drying oven 95, which is maintained at a temperature sufficient to dry the textile material as same is passed therethrough. The speed at which the textile material is passed through drying oven 95 can vary widely, the only requirement being that the residence time of the material in the oven be sufficient to dry the material. From oven 95, the dried textile material 96 is advanced to take up roll 97 which is mounted on a suitable support 98. Take up roll 97 can be a motor driven take up roll to ensure advancement of the textile material through each treating step set forth above.

Figure 2:
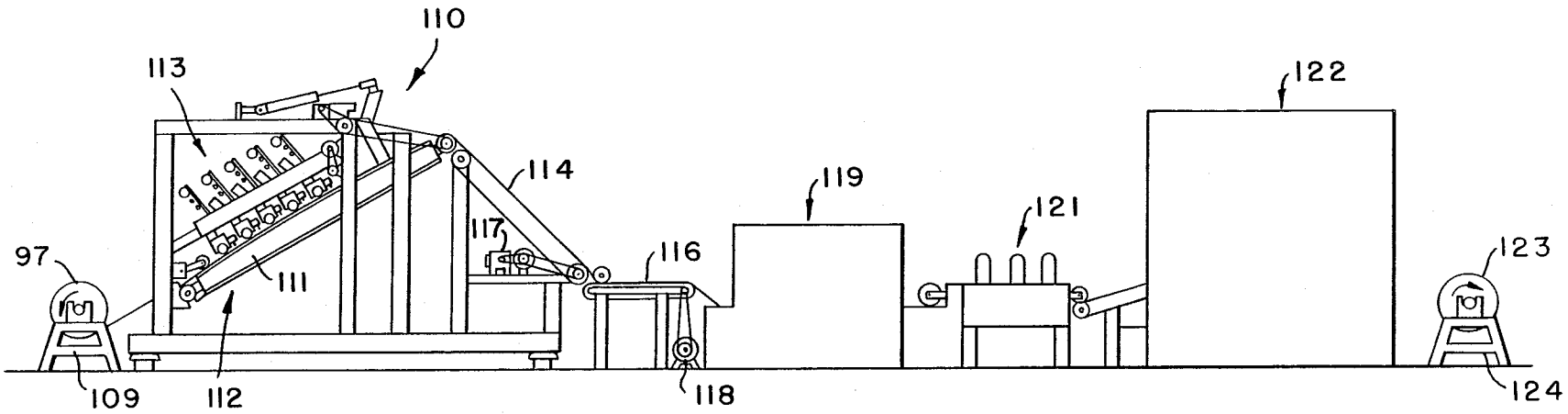
FIG. 2 is a schematic representation of an apparatus for the jet injection dyeing and printing of textile materials.

Referring now to FIG. 2, a jet dyeing apparatus is depicted to pattern dye the textile material. Take up roll 97 of FIG. 1 which now becomes supply roll 97 of FIG. 2 is mounted on a suitable support 109. The textile material is advanced through dyeing apparatus 110 as follows. The textile material is advanced onto the lower end of inclined conveyor 111 of jet applicator section 112, where the textile material is printed by a programmed operation of a plurality of jet gun bars, generally indicated at 113, which inject streams of dye onto the face surface of the textile material during its passage thereunder. The pattern dyed textile material leaving the applicator section is moved by conveyors 114 and 116, driven by motors 117 and 118 to a steam chamber 119 where the textile material is subjected to a steam atmosphere to fix the dyes thereon. The dyed textile material leaving steam chamber 119 is conveyed through a water washer 121 to remove excess unfixed dye from the textile material. Thereafter, the washed textile material is passed through a hot air dryer 122 to take up roll 123 which is mounted on a suitable support 124.

The above sequence of steps and processes set forth schematically illustrate the most desired method for producing the improved products in accordance with the subject invention. In order to more fully illustrate the concept of the subject invention the following examples are given. However, it is to be understood that such examples are not to be construed as unduly limiting the scope of the invention as set forth in the appended claims.

EXAMPLE I

A tufted polyester upholstery fabric was treated by padding with a homogeneous aqueous solution containing about one percent by weight of Hercofloc 863 (Hercules Incorporated) which is an approximately 40 percent solids solution of a water-soluble, high molecular weight (approximately 3,000,000) cationic polyacrylamide copolymer. The wet pick-up of the fabric was eighty-five percent by weight based upon the weight of the fabric.

A multicolor pattern of disperse dyes was then applied to the fabric by means of the jet dye injection apparatus described in FIG. 2. The disperse dye solution contained in addition to the dyes 0.5 percent by weight of an anionic biopolysaccharide which was purchased from Kelco, a division of Merke & Co., San Diego, Calif. and sold under the trademark Kelzan S.

The fabric sample was then atmospherically steamed at a temperature of about 220° F. for about ten minutes to fix the dyes to the fabric. The fabric was then washed and dried.

Comparison of the pattern dyed fabric made according to the procedure of Example I to a separate, control sample pattern dyed in the same manner without application of the cationic polyacrylamide copolymer revealed that the fabric dyed according to the procedure of Example I was characterized as compared to the control as having (1) Improved sharpness of print
(2) Less frost
(3) Greater dye yield
(4) Improved dye uniformity

EXAMPLES II–III

In these Examples the procedure of Example I was repeated in all respects except that the methods of application of the aqueous solution and amount of Hercofloc 863 applied to the fabric was varied.

In Examples II and III application of the aqueous solution was by spraying rather than padding to a wet pickup of about fifteen percent by weight based on the weight of the fabric. The Hercofloc 863 concentration in Examples II and III was 3 percent by weight and 0.5 percent by weight respectively. Identical results were obtained to those observed for the fabric of Example I.

EXAMPLES IV–V

In these Examples the procedure used in Example II was repeated except that the method of application of the dye solution was varied. In Example IV a screen printer was employed and in Example V a Kusters-type dye applicator was employed. Identical results to those reported for Example II were observed.

EXAMPLES VI–XII

In these Examples a variety of fabrics were dyed using the same procedure described in Example V. The dyestuff employed was in each instance a conventional dyestuff for the particular fabric to be dyed. The fabric and dye solution composition are reported in Table I below. In each instance identical results were observed for the fabric to those reported for Example V.

TABLE I

| EXAMPLE | FABRIC | DYE COMPOSITION |
|---|---|---|
| VI | Woven nylon upholstery | Disperse dye |
| VII | Woven nylon upholstery | Acid dye |
| VIII | Lightweight polyester apparel | Disperse dye |
| IX | Woven cotton | Disperse dye |
| X | Woven wool apparel | Disperse dye |
| XI | Tufted nylon carpet | Disperse dye |
| XII | Tufted wool carpet | Disperse dye |

EXAMPLES XIII–XIV

In these Examples the procedure of Example V was repeated except that the anion component was changed. In Example XIII a high molecular weight polyacrylic acid was employed. In Example XIV the anionic compound employed was sodium dodecylbenzene sulfonate. In both Examples the results were significantly improved over the control sample although slightly less print sharpness was observed than for the samples made according to the procedure of Example V.

EXAMPLE XV

The procedure described in Example V was repeated except that the cation component employed was didecyl dimethyl ammonium chloride. The results were significantly improved over the control sample although slightly less print sharpness was observed than for the samples made according to the procedure of Example V.

EXAMPLE XVI

The procedure of Example V was repeated except that a higher molecular weight (approximately 50,000) cationic polyacrylamide copolymer, namely Magnifloc 575 purchased from American Cyanamid, was employed. Identical results were observed for the fabric to those reported for Example V.

EXAMPLE XVII

The procedure of Example II was repeated with the substitution of a direct dye for the disperse dye used in Example II. Identical results were observed.

EXAMPLE XVIII

This Example illustrates the incorporation of the cationic component in the dye solution and application of the anionic component in the aqueous composition. Thus the Hercofloc 863 was added to the dye solution (a disperse dye was used). A nonionic guar hydrocolloid polygalactomannan was added to the dye composition to adjust the viscosity to about 600 centipoise. The Kelzan S was applied to the fabric as a component of the aqueous composition (0.3 percent by weight) and the wet pickup of the aqueous solution was 85 percent based on the weight of the fabric. Identical results were observed for the fabric to those reported for Example I.

EXAMPLE XIX

In this example a polyacrylamide polymer containing no cationic groups was substituted for the cationic polyacrylamide copolymer employed in some previous examples to illustrate that the skin-forming mechanism of the present invention is the result of an ionic interaction of anionic and cationic components.

Two hundred milliliters of a 0.5% mix of "pure" polyacrylamide (Aldrich) in $H_2O$ of molecular weight 5–6,000,000 was prepared. Into this mix was added by eye dropper approximately 1 gram of previously prepared 0.3% Kelzan S (anion). There was absolutely no reaction or complexing observed and the two components dispersed into each other with gentle agitation.

As a control, 1 gram of the Kelzan was placed by dropper into 100 ml of 3% Hercofloc 863 and immediately a "skin" like precipitate was formed at the interface of the cation and anion. This "skin" formed a "sac" which surrounded the bulk of the Kelzan/$H_2O$ mix. Upon rupturing the "sac" with a pin the liquid Kelzan/-$H_2O$ ran out leaving behind a water insoluble "skin."

EXAMPLE XX

This example provides further illustration of the necessity of an ionic interaction in order to achieve the desired skin formation in the process of the present invention. Two nonionic polymeric thickeners (mw >500,000) were chosen for the test. Celca Gum V60VDMIL (Celanese) which is a modified guar polygalactomannon gum, and Natrosol HXR (Hercules) which is a hydroxypropyl cellulose polymer.

One liter mixes (0.3% solids on weight of mix in $H_2O$) were prepared of each of the nonionic materials. Viscosities were in the 200–300 centipoise range as measured on a Brookfield LVT viscometer #2 spindle at 30 rpm. A small amount of colorant, disperse dye Sodecron Navy AR (Sodyeco) was added to each of the mixes as an aid in observation.

A 3% solution in $H_2O$ of Hercofloc 863 (Hercules) was prepared. Hercofloc 863 is a high molecular weight (approximately 3,000,000) cationic polyacrylamide copolymer.

With an eye dropper, approximately 1 gram of the V60VDMIL was slowly released into 100 ml of the Hercofloc solution. The nonionic and colorant dispersed readily into the cationic solution upon gentle agitation an no precipitation or complexing of any kind was observed.

The above experiment was reproduced exactly except the V60VDMIL was replaced by the Natrosal HXR material. Once again the results were the same with no interaction between the two components.

The converse of the above experiment was conducted to see if the nonionic would react with an anionic solution. A 0.3% mix was prepared using Kelzan S (Kelco). Kelzan S is a high molecular weight (approximately 5,000,000) anionic polybiosaccharide. The test procedure used previously was once again performed, introducing the nonionic material into the anionic Kelzan. No precipitation or complexing was observed.

This example thus illustrates that the particular reaction between an anionic and cationic material of appropriate molecular weight is the mechanism by which the results of the process of the present invention are achieved.

EXAMPLE XXI

In this example a series of experiments were conducted to establish the correlation between print sharpness and the molecular weight of the anionic polymer.

A group of anionic polyacrylic acids from Aldrich Chemical Co. ranging in molecular weight from 2,000 to 2,000,000 were obtained and one percent solutions of each were prepared. Hercofloc 863 was used as the cationic component (3% solution).

The polyacrylic acids were incorporated into a disperse dye print mix. It is noted that the polyacrylic acids in some cases were replaced with low molecular weight anionic surfactants to determine their print sharpness as well. The mixes consisted of V60VDMIL (nonionic) (to provide viscosity of 600 cps), the polyacrylic acid and 4 g/l of a disperse dye, Sodecron Navy Ar (Sodyeco, Inc.).

Prints were made using the apparatus described in FIG. 2 and also by means of a conventional screen printer (laboratory size) using the same conditions for all samples. The 3% cation solution was padded on the substrate at approximately a 35–40% pickup. The sample was then printed, steamed (212° F., 5 minutes), washed and dried. The prints were graded on a one to ten scale with ten being the sharpest print and the results are summarized in TABLE I below.

EXAMPLE XXII

A series of tests were conducted to determine the correlation of the "skin" which was formed to print quality and sharpness.

A 3% mix of Hercofloc 863 was prepared. Into 200 ml aliquot portions of the solution was introduced by dropper, approximately 1 gram of one of the polyacrylic acids (1%) or the anionic surfactants (1%) as reported in TABLE I below.

In each case of the chemicals shown on the chart, a "skin" or "sac" was formed. The first test of this series was to see if the "sac" could be transferred from the beaker to a papertowel where excess Hercofloc/$H_2O$ could be removed from around the "sac." Test two of this series was to transfer the sac (if it survived first test) to another paper towel. Finally, the third test was to slowly elevate the paper towel to a 70° angle and with the sac attached to the towel, determine if it could support the weight of the bulk liquid inside.

If phase 1 failed, the skin was rated poor. If phase 1 passed but phase 2 failed, it was graded as good. If phase 2 passed but phase 3 failed, it was graded very good, and if all these phases passed it was excellent. This test was fairly reproducible and was carried out several times for each chemical.

As can be seen by reference to TABLE II, there is a direct correlation between skin strength and print quality.

TABLE II

| TYPE | SKIN CHARAC-TERISTICS | PRINT CHARAC-TERISTICS |
|---|---|---|
| Xanthan Gum | EXCELLENT | 10.0 |
| Polyacrylic acid MW 2MM | EXCELLENT | 10.0 |
| Polyacrylic acid MW 250M | EXCELLENT | 9.5 |
| Polyacrylic acid MW 90M | VERY GOOD | 9.0 |
| Polyacrylic acid MW 5M | GOOD | 5.0 |
| Polyacrylic acid MW 2M | POOR | 3.0 |
| Sodium Dinonyl Naphthalene Disulfonate | POOR | 2.0 |
| Sodium Dodecyl Benzene Sulfonate | POOR | 2.0 |
| Sodium Lauryl Sulfonate | POOR | 2.0 |
| | | 1.0 Control |
| | | 10.0 Xanthan Gum and Cation |

EXAMPLE XXIII

A separate set of experiments were conducted which were similar to the tests reported in Examples XXI and XXII above except that a variety of cationic components were employed as candidates with the anionic component being Kelzan S. In all other respects the print mixture was identical.

Various cationic chemicals were padded onto the fabric in the form of a 3% solution at 30–40% pick up based on the weight of the fabric. The prints were again graded on a one to ten scale.

It was learned that a significant characteristic of the ionic component was charge density (number of reaction sites per molecule). Charge density was measured by means of the following procedure.

TITRATION PROCEDURES

The procedure for titrating the reactive groups on the Hercofloc cationic polymer was supplied by Hercules, Inc. It used potassium polyvinyl sulfate (KPVS) as the titrant.

The procedure for titrating the anionic materials (PAA) was obtained from an article by Lawrence K. Wang and William K. Shuster of Rensselar Institute, Troy, N.Y. The article was entitled "Polyelectrolyte Determination at Low Concentration." 1,5-dimethyl, 1,5-diazoundecanethylene polymethobromide (DDPM) was used as the titrant in this procedure. The results are summarized in TABLE II below.

TABLE II

| TYPE | CHARGE DENSITY (meq/gram) | SKIN CHARAC-TERISTICS | PRINT CHARAC-TERISTICS |
|---|---|---|---|
| Hercofloc 863 | 4.70 | EXCELLENT | 10 |
| Hercofloc 848 | 3.69 | VERY GOOD | |
| Hercofloc 876 | 2.73 | EXCELLENT | |
| Hercofloc 874 | 1.40 | GOOD | |
| Hercofloc 815 | 0.77 | GOOD | |
| Hercofloc 813 | 0.76 | FAIR | |
| Hercofloc 812 | 0.58 | FAIR | |
| Magnifloc 575 MW 50M | | EXCELLENT | 10 |
| Polyethylenimene MW 50–60M | | EXCELLENT | |
| Tetradecyl dimethyl benzyl ammonium Cl | | GOOD | 6–7 |
| Hexadecyl trimethyl ammonium Cl | | GOOD | 6–7 |
| Didecyl dimethyl ammonium Cl | | GOOD | 6–7 |

EXAMPLE XXIV

In this example a series of comparative experiments were conducted to compare the process of the present invention to the process reported in Canadian Pat. No. 1,153,159 to Lewis wherein improved print sharpness is allegedly obtained by means of the interaction of a polysaccharide having adjacent or hydroxyl groups with a borate compound which is characterized as having a crosslinking structural relationship with the polysaccharide component.

A 3 percent solution of Hercofloc 863 in water was padded onto a polyester fabric substrate at a 35 percent wet pick-up based upon the weight of the fabric. The fabric was then printed by means of the apparatus described in FIG. 2 by means of a dye solution containing 4 gms per liter of Kelzan S, 1 gm per liter Telon Blue BRL. Dye solution viscosity was 400 cps and the pH was 7. The printed product was then steamed at 212° F. for five minutes, washed and dried.

A separate sample of the same polyester fabric was treated by padding with a 20 percent by weight sodium borate solution at a 35 percent wet pick-up based upon the weight of the fabric. The fabric was then printed by means of the apparatus described in FIG. 2 using a dye solution containing 4 gms per liter Celca gum V60VDMIL, Telon Blue BRL and 2 gms per liter formic acid. The viscosity was 400 cps and the pH was 4.5.

Onto a separate sample of a polyester substrate was padded a solution of V60VDMIL and ammonium hydroxide. The wet pick-up was 35 percent based upon the weight of the fabric. The fabric was then printed by means of the apparatus of FIG. 2 using a dye solution containing 4 gms per liter celica gum V60VDMIL, 1 gm per liter Telon Blue BRL and 20 gms. per liter boric acid.

It was observed that all of the printed fabrics which were printed by means of the process of the present invention employing one cationic component and one anionic component were significantly superior to the samples wherein sodium borate was employed according to the procedure described in the Canadian patent. Subsequently, the same results were observed when a disperse dyestuff was substituted for the Telon Blue BRL. In addition, substantially the same results were observed when the printing means was a screen printer rather than the apparatus described in FIG. 2. Similar superior results were observed with regard to the present invention when the fabric substrate was nylon carpet rather than a flat polyester fabric substrate.

What is claimed is:

1. A process for pattern dyeing of textile materials characterized by the steps of:

a. applying to said textile material an aqueous solution;

b. applying to said textile material an aqueous solution of at least one dye in a pattern, said pattern being in the form of definite, repeatable forms and colors; and c. heating said textile material to a temperature sufficient to fix said dye to said textile material;

the improvement comprising the step of forming upon application of said aqueous solution of dye to said textile material a polymeric, water insoluble skin around individual droplets of said dye, said skin being formed by the ionic interaction of two components which come into contact upon application of the dye solution to the textile material, one component being a polyanionic, water-soluble, organic polymer and the other component being a water-soluble, organic polymeric, cationic component wherein said cationic group is a nitrogen containing cation.

2. The process of claim 1 wherein said cationic component is a polymeric material.

3. The process of claim 2 wherein said cationic component is a polymer selected from cationic polyacrylamide copolymers.

4. The process of claim 1 wherein said polyanionic, water-soluble, organic polymer is selected from anionic biopolysaccharides.

5. A process for pattern dyeing of textile materials characterized by the steps of:

a. applying to said textile material an aqueous solution;

b. applying to said textile material an aqueous solution of at least one dye in a pattern, said pattern being in the form of definite, repeatable forms and colors; and c. heating said textile material to a temperature sufficient to fix said dye to said textile material;

the improvement comprising the step of forming upon application of said aqueous solution of dye to said textile material a polymeric, water-insoluble skin around individual droplets of said dye, said skin being formed by the ionic interaction of two components which comes into contact upon application of the dye solution to the textile material, one component being a polymeric cationic, water-soluble, organic polymer wherein said cationic groups are nitrogen-containing groups and the other component being a water-soluble, organic polymeric anionic component.

6. The process of claim 5 wherein said anionic component is a polymeric material.

7. The process of claim 6 wherein said anionic component is selected from anionic biopolysaccharides.

8. In a process for improving the sharpness of a pattern of dye applied to textile materials with a jet dyeing apparatus including conveying means for transporting the textile, jet orifices for delivering dye in a pattern to said textile material and control means for supplying data to control the operation of the application of dye from the jet orifices to the textile material, said process including the sequential steps of applying an aqueous admixture to the textile material prior to dyeing of same with the jet dyeing apparatus; dyeing the textile material by applying to said textile material an aqueous solution of at least one dye in a pattern, said pattern being in the form of definite, repeatable forms and colors; and heating said textile material to a temperature sufficient to fix said dye to said textile material; and recovering a resulting dyed textile material, the improvement comprising the step of forming upon application of said aqueous solution of dye to said textile material a polymeric, water-soluble skin around individual droplets of said dye, said skin being formed by the ionic interaction of two components which come into contact upon application of the dye solution to the textile material, one component being a polyanionic, water-soluble, organic polymer and the other component being a water-soluble, organic polymeric, cationic material wherein said cationic group is a nitrogen containing cation.

9. The product produced by the process of claim 8.

10. The process as defined in claim 8 wherein said polyanionic, water-soluble, organic polymer is provided as a component of the dye solution in an amount of from about 0.1 to about 5 weight percent of said solution.

11. The process as defined in claim 10 wherein said polyanionic, water-soluble, organic polymer is an anionic biopolysaccharide having a molecular weight greater than about 5,000.

12. The process as defined in claim 10 wherein said water-soluble, organic, cationic material is applied to said textile material as a component of said aqueous admixture in an amount of from about 0.2 percent to about 10 percent by weight based upon the weight of the aqueous admixture.

13. The process as defined in claim 12 wherein said water-soluble, organic, cationic material is a polyacrylamide copolymer having nitrogen containing cation groups, said copolymer having a molecular weight of at least about 5,000.

* * * * *